United States Patent [19]

Suzuki et al.

[11] Patent Number: 4,523,570

[45] Date of Patent: Jun. 18, 1985

[54] FUEL INJECTION CONTROL IN INTERNAL COMBUSTION ENGINE

[75] Inventors: Yukio Suzuki; Kunihiko Sato; Motoyasu Muramatsu, all of Toyota, Japan

[73] Assignee: Toyota Jidosha Kabushiki Kaisha, Toyota, Japan

[21] Appl. No.: 482,710

[22] Filed: Apr. 6, 1983

[30] Foreign Application Priority Data

Apr. 7, 1982 [JP] Japan ..... 57-56739

[51] Int. Cl.[3] ..... F02M 51/00

[52] U.S. Cl. ..... 123/478; 123/480

[58] Field of Search ..... 123/478, 480, 492, 505

[56] References Cited

U.S. PATENT DOCUMENTS 4,112,879 9/1978 Assenheimer et al. ..... 123/478
4,155,332 5/1979 Yaegashi et al. ..... 123/478
4,282,842 8/1981 Sasayama ..... 123/478
4,335,695 6/1982 Phipps ..... 123/478
4,383,515 5/1983 Higashiyama et al. ..... 123/478
4,389,996 6/1983 Yaegashi et al. ..... 123/478

FOREIGN PATENT DOCUMENTS 188738 11/1982 Japan ..... 123/492

*Primary Examiner*—Parshotam S. Lall
*Attorney, Agent, or Firm*—Cushman, Darby & Cushman

[57] ABSTRACT

A method for controlling the fuel injection in an internal combustion engine using an upper limit of the pulse width of the fuel injection signal established on the basis of the limit intake air amount and the limit intake air amount per rotation multiplied by a predetermined constant. The fuel injection is carried out by the signal having the pulse width within the upper limit so that an over-rich air-fuel mixture is prevented.

5 Claims, 4 Drawing Figures

FUEL INJECTION CONTROL IN INTERNAL COMBUSTION ENGINE

BACKGROUND OF THE INVENTION

1. Field of the Invention

The present invention relates to a method for controlling the fuel injection in an internal combustion engine. The method according to the present invention is used, for example, for an internal combustion engine for an automobile equipped with an L-J type electronic fuel injection controller (EFI) with an air flow meter.

2. Description of the Prior Art

In general, in an internal combustion engine equipped with an L-J type EFI, the air flow meter is influenced by air pulsation in the air intake pipe in the high intake air range. Hence, the opening degree of the air flow meter due to the rotation of the plate of the air flow meter tends to become excessive.

In the above-mentioned EFI, the pulse width $\tau$ of the fuel injection signal is controlled according to the following equation:

$$\tau = C \cdot Q/N \quad (1)$$

wherein Q is the amount of the intake air, N is the engine rotational speed and C is a predetermined constant.

Hence, $\tau$ is increased as Q is increased. Thus, there is a problem in that, when the air flow meter is influenced by air pulsation in the air intake pipe in the high intake air range and the opening degree of the air flow meter becomes excessive, the amount of injected fuel becomes excessive, making the air-fuel mixture over-rich and, accordingly, causing insufficient engine output power.

SUMMARY OF THE INVENTION

It is the object of the present invention to provide an improved method for controlling the fuel injection in an internal combustion engine by which an over-rich air-fuel mixture is avoided, sufficient output power is ensured, and, thus, suitable engine running is realized.

In accordance with the present invention, there is provided a method for controlling the fuel injection in an internal combustion engine, using a control circuit for calculating the pulse width of the fuel injection signal on the basis of the engine rotational speed, the intake air amount, and other engine running conditions. In the calculation in the control circuit, an upper limit of the pulse width of the fuel injection signal is established on the basis of the limit intake air amount and the limit intake air amount per rotation multiplied by a predetermined constant, fuel injection signals having the pulse width within the upper limit are generated, and fuel injection is carried out by supplying the generated fuel injection signals, whereby an over-rich air-fuel mixture is prevented.

DESCRIPTION OF THE PREFERRED EMBODIMENT

Figure 1:
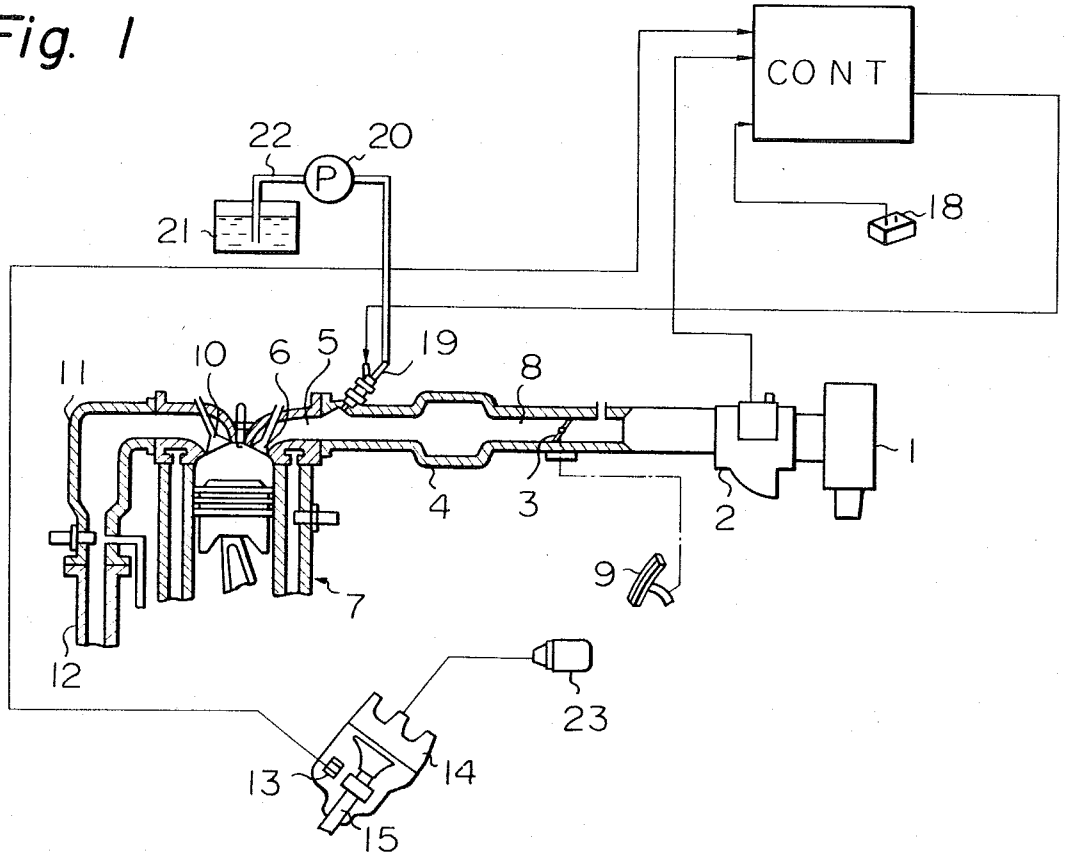
FIG. 1 illustrates a device for carrying out a method for controlling the fuel injection in an internal combustion engine.

A device for carrying out a method for controlling the fuel injection in an internal combustion engine according to the present invention is illustrated in FIG. 1. The device of FIG. 1 is used for control of the pulse width for fuel injection and control of the ignition timing a gasoline internal combustion engine of the spark ignition type.

The device of FIG. 1 includes an air cleaner 1, an air flow meter 2, an air intake pipe 8 having a throttle valve 3 actuated by an accelerator pedal 9 and a surge tank 4, a fuel injection valve 19, an air intake port 5, an engine cylinder 7, an air intake valve 6, an exhaust valve 10, an exhaust manifold 11, and an exhaust pipe 12. The device of FIG. 1 also includes a fuel tank 21, a fuel path 22, a fuel injection pump 20 which supplies the fuel to the fuel injection valve 19, an ignition coil 23, a distributor 14 having a distributor shaft 15, a crank angle sensor 13, a controller circuit CONT, and a battery 18.

The air introduced into the air intake pipe 8 is mixed at the air intake port 5 with the fuel injected from the fuel injection valve 19. The thus mixed gas is supplied into the combustion chamber of the engine cylinder 7 when the air intake valve 6 is opened. The combusted gas is led to the exhaust manifold 11 when the exhaust valve 10 is opened and is exhausted through the exhaust pipe 12.

A signal corresponding to the intake air amount Q and a signal corresponding to the engine rotational speed N are supplied to the controller circuit CONT from the air flow meter 2, and from the crank angle sensor 13, respectively.

An output signal for controlling the fuel injection amount is supplied to the fuel injection valve 19.

Figure 2:
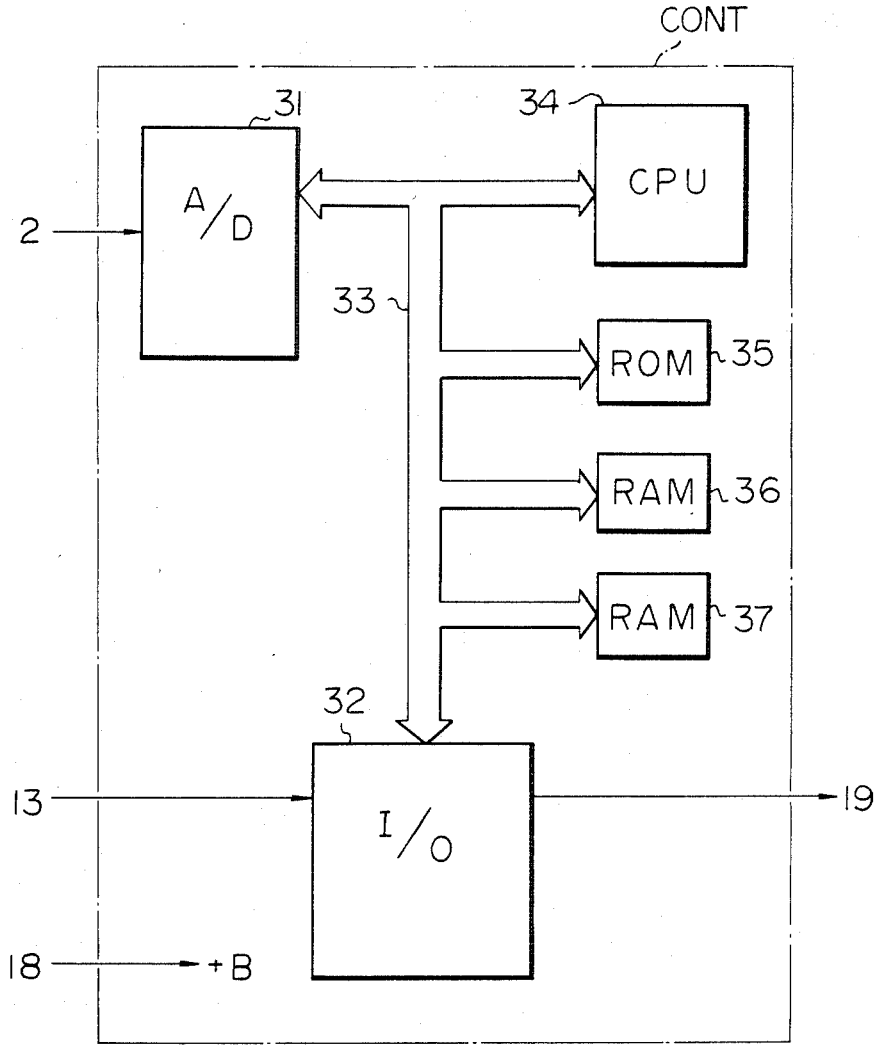
FIG. 2 illustrates the structure of the control circuit in the device of FIG. 1.

The structure of the controller circuit CONT in the device of FIG. 1 is illustrated in FIG. 2. The controller circuit CONT includes an analog-to-digital converter with multiplexer 31, an input/output circuit with buffer 32, a bus line 33, a central processor unit (CPU) 34, a read only memory (ROM) 35, and random access memories (RAM's) 36, 37. The analog-to-digital converter with multiplexer 31 receives the signal corresponding to the intake air amount Q from the air flow meter 2. The input/output circuit with buffer 32 receives the signal corresponding to the engine rotational speed N from the crank angle sensor 13 and supplies the signal for controlling the fuel injection amount of the fuel injection valve 19. The power (+B) is supplied from the battery 18 to the controller circuit CONT.

In the operation of the controller circuit CONT, the upper limit of the pulse width of fuel injection is established by calculating the limit intake air amount Q (lim) and the limit intake air amount per rotation Q/N (lim) multiplied by a predetermined constant C, so that the fuel injection pulse having the pulse width within the established upper limit is generated. The reason for setting the upper limit intake air amount Q is as follows. The intake air amount is increased as the engine rotational speed is increased from a low speed, and, in the range where the engine rotational speed is higher than a predetermined value, the intake air amount is saturated to maintain a constant intake air amount. Since there exists the relationship $\tau = C \cdot Q/N$, in the above-mentioned intake air amount saturated range, the fuel injection period $\tau$ should be decreased as the engine rotational speed is increased. Thus, in order to decrease the fuel injection period $\tau$ as the engine rotational speed is increased, it is necessary to set the upper limit intake air amount Q.

Figure 3:
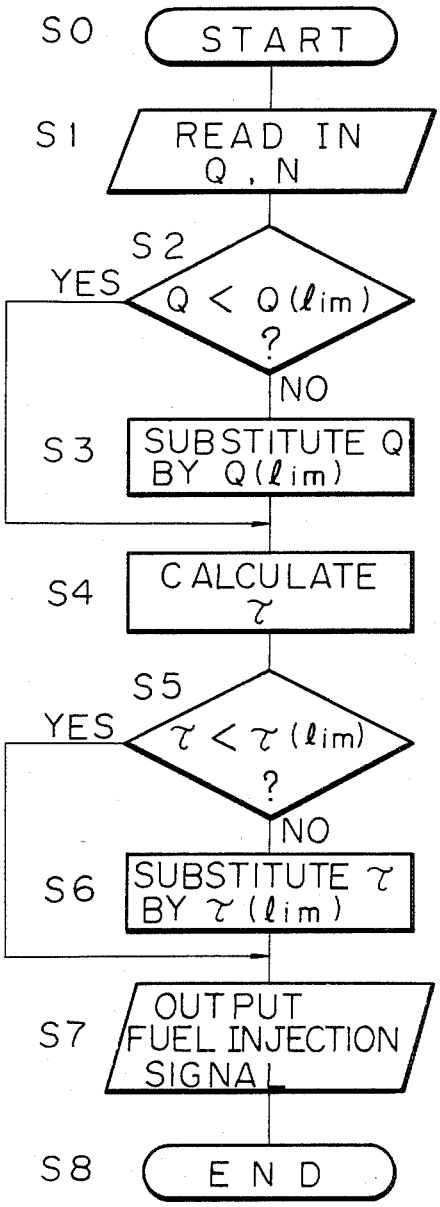
FIG. 3 is a flow chart of an example of the operation of the controller circuit of FIG. 2.

A flow chart of an example of the operation of the controller circuit CONT is shown in FIG. 3. The routine of FIG. 3, consisting of steps S0 through S8, is carried out in each routine for calculating the pulse width of fuel injection in the main routine of the EFI. In step S0, the routine is started, and in step S1, the intake air amount Q and engine rotational speed N are read in.

In step S2, a decision whether or not the read-in intake air amount Q is less than a predetermined limit intake air amount Q (lim) is carried out. When the decision is YES, the routine proceeds to step S4, while when the decision is NO, the routine proceeds to step S3.

In step S3, Q is substituted by Q (lim). This means that Q is prevented from exceeding Q (lim). In step S4, the fuel injection period is calculated in accordance with the equation:

$$\tau = C \cdot Q/N$$

In step S5, a decision whether or not the calculated fuel injection period $\tau$ is less than a predetermined limit fuel injection period $\tau$ (lim) is carried out. When the decision is YES, the routine proceeds to step S7, while when the decision is NO, the routine proceeds to step S6.

In step S6, $\tau$ is substituted by $\tau$ (lim). This means that $\tau$ is prevented from exceeding $\tau$ (lim). In step S7, the thus obtained signal representing the pulse width of fuel injection is delivered, and in step S8, the routine is terminated.

Figure 4:
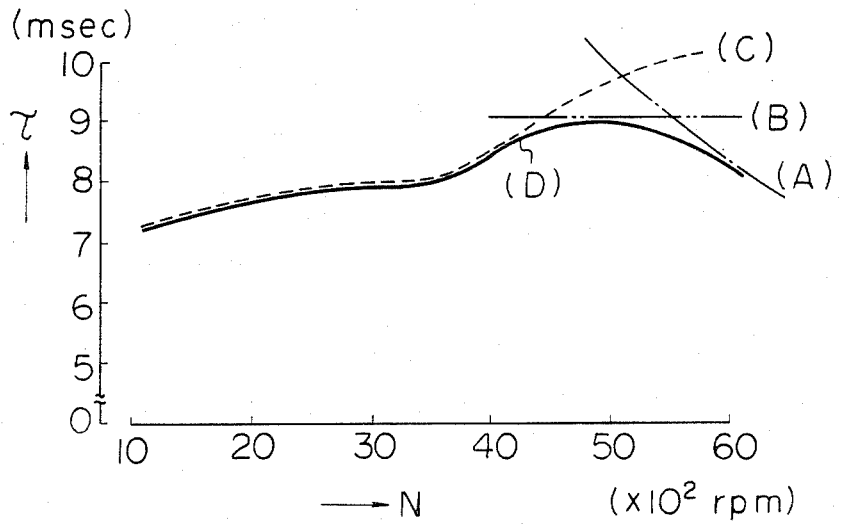
FIG. 4 illustrates the characteristic of the change of the pulse width of the fuel injection signal.

The characteristic of the change of the pulse width of the fuel injection signal is illustrated in FIG. 4, in which the abscissa represents the engine rotational speed N and the ordinate represents the pulse width $\tau$ of the fuel injection signal.

In FIG. 4, the straight chain line A indicates the setting of the limit intake air amount Q (lim) as described with regard to the device of FIG. 1. The straight chain line B in FIG. 4 indicates the setting of the limit intake air amount per rotation Q/N (lim) as described with regard to the device of FIG. 1.

The broken line curve C indicates the change of the pulse width $\tau$ of the fuel injection signal with respect to the engine rotational speed N in the prior art device, in which the air flow meter tends to excessively open because of air pulsation.

According to the device of FIG. 1, the change of the pulse width $\tau$ of the fuel injection signal with respect to the engine rotational speed N is controlled so as not to exceed the limits of the straight chain lines A and B, thus resulting in the characteristics as shown by the solid line curve D, which is approximately the same as the desirable curve required from the operation characteristics of the engine.

We claim:

1. A method for controlling fuel injection in an internal combustion engine comprising the steps of:

using a control circuit for calculating a pulse width of a fuel injection signal on the basis of engine rotational speed, intake air amount measured by an air flow meter, and other engine running conditions;

establishing an upper limit value for the pulse width of the fuel injection signal on the basis of a maximum intake air amount and that amount per rotation multiplied by a predetermined constant;

generating fuel injection signals having a pulse width within said upper limit; and carrying out fuel injection by supplying said generated fuel injection signals to the internal combustion engine, thereby preventing an over-rich air-fuel mixture.

2. A method for controlling fuel injection in an internal combustion engine, said method comprising the steps of:

providing a control circuit for calculating a pulse width of a fuel injection signal on the basis of engine rotational speed N, intake air amount Q measured by an air flow meter, and other engine running conditions;

reading-in to the control circuit intake air amount Q and engine rotational speed N;

deciding first whether said read-in intake air amount Q is less than a predetermined limit intake air amount Q (lim);

when said first decision is negative, substituting said read-in intake air amount Q by Q (lim);

calculating a fuel injection period $\tau$ by using Q (lim) and N and a predetermined constant C;

deciding second whether said calculated fuel injection period $\tau$ is less than a predetermined limit fuel injection period $\tau$ (lim);

when said second decision is negative, substituting said calculated fuel injection period $\tau$ by said predetermined limit fuel injection period $\tau$ (lim); and delivering a fuel injection signal to said internal combustion engine by using said value $\tau$ (lim).

3. A method as defined in claim 2, wherein:

when said first decision is affirmative, the calculation of fuel injection period $\tau$ is carried out by using the values Q and N and a predetermined constant C.

4. A method as defined in claim 2, wherein:

when said second decision is affirmative, the delivery of said fuel injection signal is carried out by using said calculated fuel injection period $\tau$.

5. A method as defined in claim 3, wherein:

when said second decision is affirmative, the delivery of said fuel injection signal is carried out by using said calculated fuel injection period $\tau$.

* * * * *